US010403259B2

(12) United States Patent
Unruh

(10) Patent No.: US 10,403,259 B2
(45) Date of Patent: Sep. 3, 2019

(54) MULTI-MICROPHONE FEEDFORWARD ACTIVE NOISE CANCELLATION

(71) Applicant: Knowles Electronics, LLC, Itasca, IL (US)

(72) Inventor: Andrew David Unruh, San Jose, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/780,836

(22) PCT Filed: Dec. 2, 2016

(86) PCT No.: PCT/US2016/064635

§ 371 (c)(1),
(2) Date: Jun. 1, 2018

(87) PCT Pub. No.: WO2017/096174

PCT Pub. Date: Jun. 8, 2017

(65) Prior Publication Data

US 2018/0366099 A1 Dec. 20, 2018

Related U.S. Application Data

(60) Provisional application No. 62/263,513, filed on Dec. 4, 2015.

(51) Int. Cl.
*G10K 11/178* (2006.01)

(52) U.S. Cl.
CPC .... *G10K 11/17823* (2018.01); *G10K 11/1781* (2018.01); *G10K 11/17853* (2018.01);
(Continued)

(58) Field of Classification Search
CPC ..... G10K 11/17823; G10K 11/17853; G10K 11/17857; G10K 11/17873;
(Continued)

(56) References Cited

U.S. PATENT DOCUMENTS 7,319,959 B1 1/2008 Watts
8,032,364 B1 10/2011 Watts
(Continued)

OTHER PUBLICATIONS

International Search Report and Written Opinion, PCT/US2016/064635, Knowles Electronics, LLC, 9 pages (dated Feb. 17, 2017).

*Primary Examiner* — William A Jerez Lora
(74) *Attorney, Agent, or Firm* — Foley & Lardner LLP

(57) ABSTRACT

Systems and methods for active noise cancellation are provided. An example method includes receiving at least two reference signals associated with at least two reference positions. Each of the at least two reference signals includes at least one captured acoustic sound representing an unwanted noise. The reference signals are filtered by individual filters to obtain filtered signals. The filtered signals are combined to obtain a feedforward signal. The feedforward signal is played back to reduce the unwanted noise at a pre-determined space location. The individual filters are determined based on linear combinations of at least two transfer functions. Each of the at least two transfer functions is associated with one of the reference positions. In certain embodiments, the at least two reference signals are captured by at least two feedforward microphones.

20 Claims, 5 Drawing Sheets

(52) U.S. Cl.
CPC .. *G10K 11/17857* (2018.01); *G10K 11/17873* (2018.01); *G10K 2210/1081* (2013.01); *G10K 2210/3026* (2013.01); *G10K 2210/3027* (2013.01); *G10K 2210/3028* (2013.01); *G10K 2210/3046* (2013.01); *G10K 2210/3055* (2013.01)

(58) Field of Classification Search
CPC ..... G10K 11/1781; G10K 2210/1081; G10K 2210/3026; G10K 2210/3027; G10K 2210/3028; G10K 2210/3046; G10K 2210/3055
USPC ..... 381/71.11, 71.6, 97
See application file for complete search history.

(56) References Cited

U.S. PATENT DOCUMENTS 8,194,882 B2 6/2012 Every et al.
8,378,871 B1 2/2013 Bapat
8,447,045 B1 * 5/2013 Laroche ..... A61F 11/14 381/71.1
8,447,596 B2 5/2013 Avendano et al.
8,473,285 B2 6/2013 Every et al.
8,473,287 B2 6/2013 Every et al.
8,526,628 B1 9/2013 Massie et al.
8,538,035 B2 9/2013 Every et al.
8,606,571 B1 12/2013 Every et al.
8,611,551 B1 12/2013 Massie et al.
8,611,552 B1 12/2013 Murgia et al.
8,615,394 B1 12/2013 Avendano et al.
8,682,006 B1 3/2014 Laroche et al.
8,718,290 B2 5/2014 Murgia et al.
8,744,844 B2 6/2014 Klein
8,781,137 B1 7/2014 Goodwin
8,831,937 B2 9/2014 Murgia et al.
8,848,935 B1 9/2014 Massie et al.
8,886,525 B2 11/2014 Klein
8,949,120 B1 2/2015 Every et al.
8,958,572 B1 2/2015 Solbach
9,008,329 B1 4/2015 Mandel et al.
9,143,857 B2 9/2015 Every et al.
9,185,487 B2 11/2015 Solbach et al.
9,245,538 B1 1/2016 Avendano et al.
9,307,321 B1 4/2016 Unruh
9,343,056 B1 5/2016 Goodwin
9,343,073 B1 5/2016 Murgia et al.
9,431,023 B2 8/2016 Avendano et al.
9,437,180 B2 9/2016 Murgia et al.
9,438,992 B2 9/2016 Every et al.
9,502,048 B2 11/2016 Every et al.
9,558,755 B1 1/2017 Laroche et al.
9,620,142 B2 * 4/2017 Keller ..... G10L 21/0208
9,640,194 B1 5/2017 Nemala et al.
9,779,716 B2 10/2017 Gadonniex et al.
9,799,330 B2 10/2017 Nemala et al.
9,812,149 B2 11/2017 Yen
9,830,899 B1 11/2017 Every et al.
2008/0112570 A1 5/2008 Asada et al.
2009/0010447 A1 1/2009 Waite et al.
2010/0195844 A1 8/2010 Christoph et al.
2010/0272283 A1 10/2010 Carreras et al.
2014/0126734 A1 * 5/2014 Gauger, Jr. ..... H04R 3/002 381/71.6
2017/0208391 A1 7/2017 Shah et al.

* cited by examiner

MULTI-MICROPHONE FEEDFORWARD ACTIVE NOISE CANCELLATION

CROSS-REFERENCE TO RELATED APPLICATIONS

This application is a National Stage Application of PCT/US2016/064635, filed Dec. 2, 2016, which claims the benefit of and priority to U.S. Provisional Patent Application No. 62/263,513, filed Dec. 4, 2015, the entire contents of which are incorporated herein by reference.

SUMMARY

Systems and methods for active noise cancellation (ANC) are provided. Embodiments of the present disclosure can improve the level and frequency range of active noise cancellation in headsets. A single microphone feedforward system can work well for frequencies where the coherence between the microphone and the eardrum is close to one. Typically, a single microphone feedforward ANC system can provide reliable performance when noise arrives from one source direction only. In contrast, a multi-microphone feedforward ANC system with N feedforward microphones can provide reliable ANC for noise arriving from N directions when the method according to various embodiments of the present technology is utilized. If the feedforward microphones are placed in close proximity to each other, good cancellation can be realized for noise coming from intermediate directions. A two dimensional simulation with 5 microphones, for example, can show that noise cancellation up to 20 kHz can be realized for all source directions. Suitably reliable performance substantially better than other solutions may be achieved with processing, according to various embodiments of the present technology, where there are two or more feedforward microphones.

An example method for active noise cancellation includes receiving at least two reference signals associated with at least two reference positions. In certain embodiments, the at least two reference signals are captured by at least two feedforward microphones. Each of the at least two reference signals includes at least one captured acoustic sound representing an unwanted noise. The reference signals are filtered by individual filters to obtain filtered signals. The filtered signals are combined to obtain a feedforward signal. The feedforward signal can be played back to reduce the unwanted noise at a pre-determined space location. The individual filters are determined based on linear combinations of at least two transfer functions, each of the at least transfer functions being associated with one of the reference positions.

BACKGROUND

An active noise cancellation (ANC) system in an earpiece-based audio device can be used to reduce background noise. The ANC system can form a compensation signal adapted to cancel background noise at a listening position inside the earpiece. The compensation signal is provided to an audio transducer (e.g., a loudspeaker) which generates an "anti-noise" acoustic wave. The anti-noise acoustic wave is intended to attenuate or eliminate the background noise at the listening position via destructive interference, so that only the desired audio remains. Consequently, the combination of the anti-noise acoustic wave and the background noise at the listening position results in cancellation of both and hence a reduction in noise.

ANC systems can generally be divided into feedforward ANC systems and feedback ANC systems. In a typical feedforward ANC system, a single feedforward microphone provides a reference signal based on the background noise captured at a reference position. The reference signal is then used by the ANC system to predict the background noise at the listening position so that it can be cancelled. Typically, this prediction utilizes a transfer function which models the acoustic path from the reference position to the listening position. The ANC is then performed to form a compensation signal adapted to cancel the noise, whereby the reference signal is inverted, weighted, and delayed or, more generally, filtered based on the transfer function.

Errors in a feedforward ANC can occur due to the difficulty in forming a transfer function which accurately models the acoustic path from the reference position to the listening position. Specifically, since the surrounding acoustic environment is rarely fixed, the background noise at the listening position is constantly changing. For example, the location and number of noise sources which form the resultant background noise can change over time. These changes affect the acoustic path from the reference position to the listening position. For example, a propagation delay of the background noise between the reference position and the listening position depends on the direction (or directions) the background noise is coming from. Similarly, the amplitude difference of the background noise at the reference position and at the listening position may depend on the direction.

DETAILED DESCRIPTION

The present technology provides systems and methods for robust feedforward active noise cancellation which can overcome or substantially alleviate problems associated with the diverse and dynamic nature of the surrounding acoustic environment. Embodiments of the present technology may be practiced on any earpiece-based audio device that is configured to receive and/or provide audio such as, but not limited to, cellular phones, MP3 players, phone handsets, and headsets. While some embodiments of the present technology are described in reference to operation of a cellular phone, the present technology may be practiced on any audio device.

Figure 1:
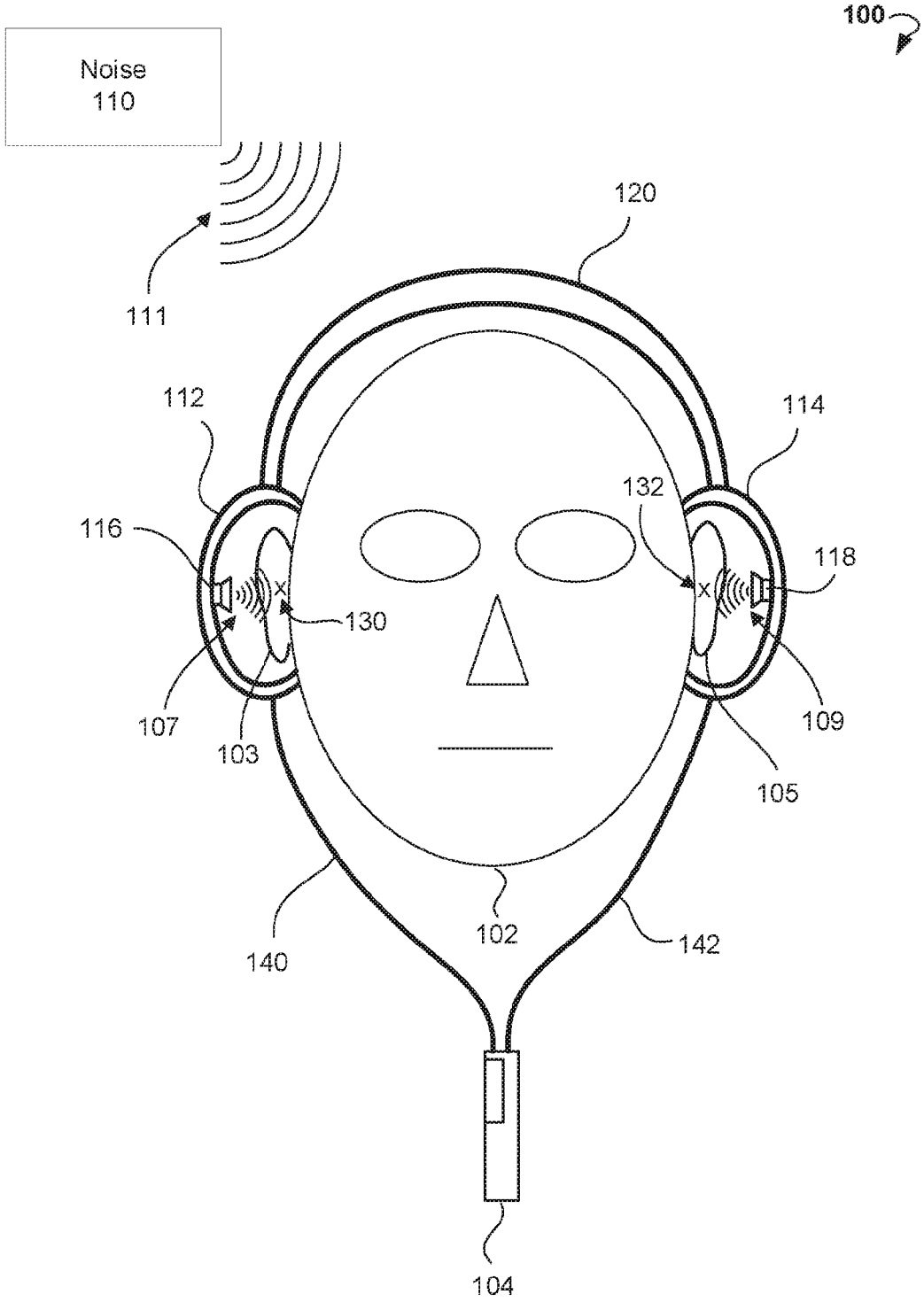
FIG. 1 is an illustration of an environment in which embodiments of the present technology may be used.

FIG. 1 is an illustration of an environment 100 in which embodiments of the present technology are used, according to various example embodiments. In some embodiments, an audio device 104 acts as a source of audio content to a headset 120 which is worn over or in ears 103 and 105 of a user 102. In some embodiments, the audio content provided by the audio device 104 is stored on a storage media such as a memory device, an integrated circuit, a CD, a DVD, and so forth for playback to the user 102. In certain embodiments, the audio content provided by the audio device 104 includes a far-end acoustic signal received over a communications network, such as speech of a remote person talking into a second audio device. In various embodiments, the audio device 104 provides the audio content as mono or stereo acoustic signals to the headset 120 via one or more audio outputs. As used herein, the term "acoustic signal" refers to a signal derived from or based on an acoustic wave corresponding to actual sounds, including acoustically derived electrical signals which represent an acoustic wave.

In the embodiment illustrated in FIG. 1, the exemplary headset 120 includes a first earpiece 112 positionable on or in the ear 103 of the user 102, and a second earpiece 114 positionable on or in the ear 105 of the user 102. Alternatively, in other embodiments, the headset 120 includes a single earpiece. The term "earpiece" as used herein refers to any sound delivery device positionable on or in a person's ear.

In various embodiments, the audio device 104 is coupled to the headset 120 via one or more wires, a wireless link, or any other mechanism for communication of information. In the example in FIG. 1, the audio device 104 is coupled to the first earpiece 112 via wire 140, and is coupled to the second earpiece 114 via wire 142.

The first earpiece 112 includes an audio transducer 116, which generates an acoustic wave 107 near the ear 103 of the user 102 in response to a first acoustic signal. The second earpiece 114 includes an audio transducer 118 which generates an acoustic wave 109 near the ear 105 of the user 102 in response to a second acoustic signal. In various embodiments, each of the audio transducers 116, 118 is a loudspeaker, or any other type of audio transducer which generates an acoustic wave in response to an electrical signal.

The first acoustic signal can include a desired signal such as the audio content provided by the audio device 104. In various embodiments, the first acoustic signal also includes a first feedforward signal adapted to cancel undesired background noise at a first listening position 130 using the techniques described herein. Similarly, the second acoustic signal can include a desired signal such as the audio content provided by the audio device 104. In various embodiments, the second acoustic signal also includes a second feedforward signal adapted to cancel undesired background noise at a second listening position 132 using the techniques described herein. In some alternative embodiments, the desired signals are omitted.

As shown in FIG. 1, an acoustic wave (or waves) 111 can also be generated by noise 110 in the environment surrounding the user 102. Although the noise 110 is shown coming from a single location in FIG. 1, the noise 110 includes any sounds coming from one or more locations that differ from the location of the transducers 116 and 118. In some embodiments, the noise 110 includes reverberations and echoes. In various embodiments, the noise 110 is stationary, non-stationary, and/or a combination of both stationary and non-stationary noise.

The total acoustic wave at the first listening position 130 may be a superposition of the acoustic wave 107 generated by the transducer 116 and the acoustic wave 111 generated by the noise 110. In some embodiments, the first listening position 130 is in front of the eardrum of ear 103 such that the user 102 would be exposed to hear the total acoustic wave. As described herein, a portion of the acoustic wave 107 associated with the first feedforward signal can be configured to destructively interfere with the acoustic wave 111 at the first listening position 130. In other words, a combination of the portion of the acoustic wave 107 associated with the first feedforward signal and the acoustic wave 111 associated with the noise 110 at the first listening position 130 can result in cancellation of both and, hence, a reduction in the acoustic energy level of noise at the first listening position 130. According to various embodiments, a result is that the portion of the acoustic wave 107 that is associated with the desired audio signal remains at the first listening position 130, where the user 102 will hear it.

Similarly, the total acoustic wave at the second listening position 132 may be a superposition of the acoustic wave 109 generated by the transducer 118 and the acoustic wave 111 generated by the noise 110. In some embodiments, the second listening position 132 is in front of the eardrum of the ear 105. Using the techniques described herein, the portion of the acoustic wave 109 due to the second feedforward signal can be configured to destructively interfere with the acoustic wave 111 at the second listening position 132. In other words, the combination of the portion of the acoustic wave 109 associated with the second feedforward signal and the acoustic wave 111 associated with the noise 110 at the second listening position 132 can result in cancellation of both. According to various embodiments, a result is that the portion of the acoustic wave 109 that is associated with the desired signal remains at the second listening position 132, where the user 102 will hear the desired signal.

Figure 2:
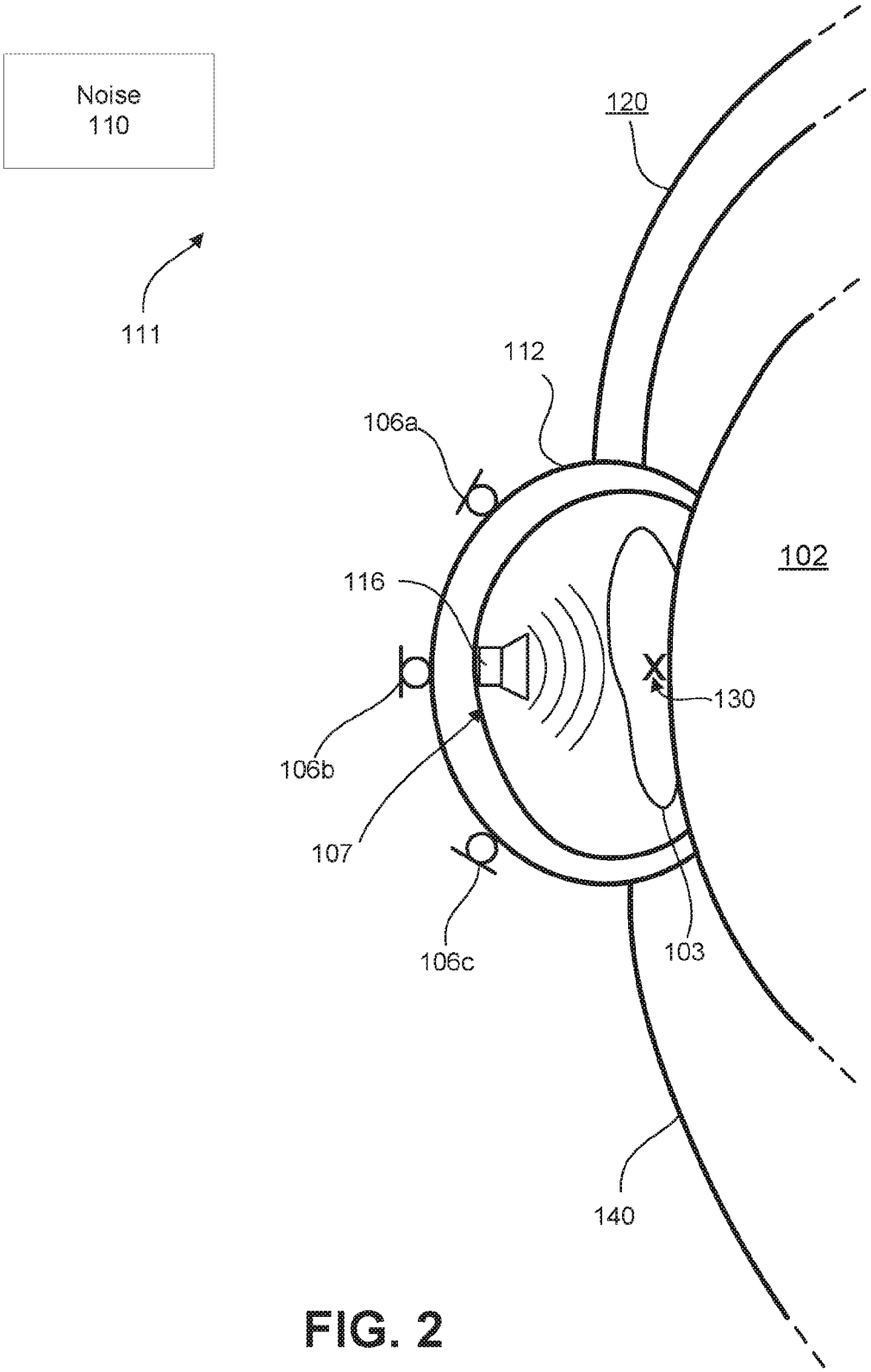
FIG. 2 is an expanded view of FIG. 1.

FIG. 2 is an expanded view of the first earpiece 112, according to various embodiments. In the following discussion, active noise cancellation techniques are described herein with reference to the first earpiece 112. It will be understood that the techniques described herein can also be extended to the second earpiece 114 to perform active noise cancellation at the second listening position 132.

As shown in the example in FIG. 2, the first earpiece 112 includes feedforward microphones 106*a*, 106*b*, and 106*c* (also referred to herein as feedforward microphones $M_1$, $M_2$, and $M_3$) at reference positions on the outside of the first earpiece 112. The acoustic wave 111 due to the noise 110 can be picked up by the feedforward microphones 106*a*, 106*b*, and 106*c*. In the example in FIG. 2, the signal received by the feedforward microphones 106*a*, 106*b*, and 106*c* is referred to herein as the reference signals $r_1(t)$, $r_2(t)$, and $r_3(t)$, respectively. It should be understood, however, that while the example shown in the FIG. 2 includes 3 feedforward microphones, other embodiments of the present technology may include any number N of references microphones, wherein N is equal or larger than 2.

As described below, parameters of a transfer function may be computed to model the acoustic paths from the locations of the feedforward microphones 106*a*, 106*b*, and 106*c* to the first listening position 130. Generation of the transfer function H(s) is described below with reference to the example in FIG. 4. According to various embodiments, the transfer function incorporates characteristics of the acoustic paths, such as one or more of amplitude, phase shifts and time delays between each of the feedforward microphones 106*a*, 106*b*, and 106*c* and the source of noise 110. The transfer function can also model responses of the feedforward microphones 106*a*, 106*b*, and 106*c*, the transducer 116 response, and the acoustic path from the transducer 116 to the first listening position 130.

In various embodiments, the reference signals $r_1(t)$, $r_2(t)$, and $r_3(t)$ are each filtered based on the transfer function to form feedforward signal f(t). An acoustic signal t(t), which includes the feedforward signal f(t) and, optionally, a desired signal s(t) from the audio device 104, is provided to the audio transducer 116. Active noise cancellation is then performed at the first listening position 130, whereby the audio transducer 116 generates the acoustic wave 107 in response to the acoustic signal t(t).

Figure 3:
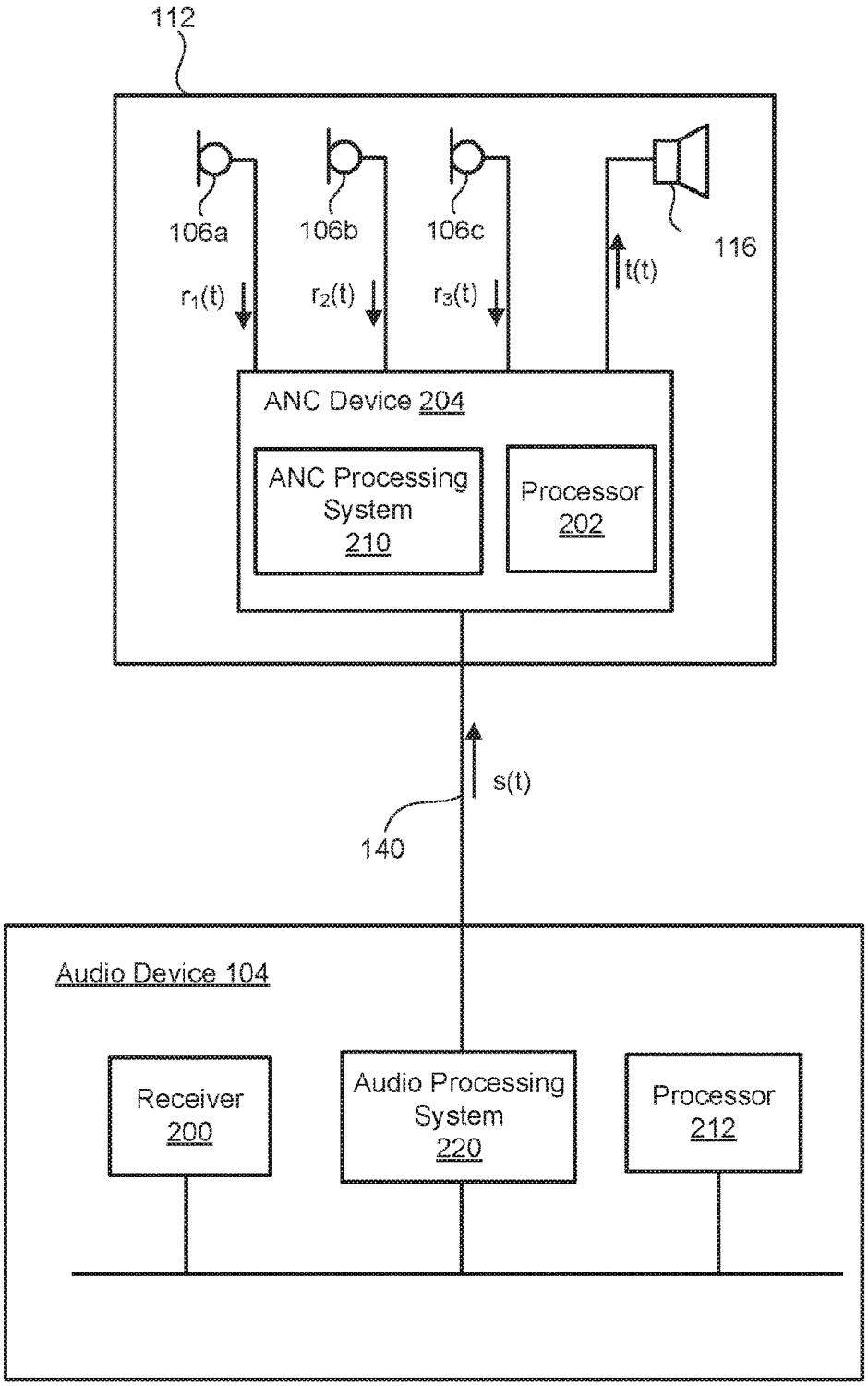
FIG. 3 is a block diagram of an audio device coupled to a first earpiece of the headset, according to various embodiments of the present disclosure.

FIG. 3 is a block diagram of an audio device 104 coupled to an example first earpiece 112 of the headset 120. In the illustrated embodiment, the audio device 104 is coupled to the first earpiece 112 via a wire 140. In some embodiments, the audio device 104 is coupled to the second earpiece 114 in a similar manner. Alternatively, in other embodiments, other mechanisms are used to couple the audio device 104 to the headset 120.

In the illustrated embodiment, the audio device 104 includes a receiver 200, a processor 212, and an audio processing system 220. In some embodiments, the audio device 104 includes additional or other components necessary for operation of the audio device 104. Similarly, in other embodiments, the audio device 104 includes fewer components that perform similar or equivalent functions to those depicted in FIG. 2. In some embodiments, the audio device 104 includes one or more microphones and/or one or more output devices.

In some embodiments, processor 212 executes instructions and modules stored in a memory (not illustrated in FIG. 3) of the audio device 104 to perform various operations. Processor 212 includes hardware and software implemented as a processing unit, which processes floating operations and other operations for the processor 212.

In some embodiments, the receiver 200 is an acoustic sensor configured to receive a signal from a communications network. In some embodiments, the receiver 200 includes an antenna device. The signal may be forwarded to the audio processing system 220, and provided as audio content to the user 102 via the headset 120 in conjunction with ANC techniques described herein. The present technology can be used in one or both of the transmission and receipt paths of the audio device 104.

The audio processing system 220 is configured to provide desired audio content to the first earpiece 112 in the form of desired audio signal s(t). Similarly, the audio processing system 220 is configured to provide desired audio content to the second earpiece 114 in the form of a second desired audio signal (not illustrated). In some embodiments, the audio content is retrieved from data stored on a storage media, such as a memory device, an integrated circuit, a CD, a DVD, and so forth, for playback to the user 102. In some embodiments, the audio content includes a far-end acoustic signal received over a communications network, such as speech of a remote person talking into a second audio device. The desired audio signals may be provided as mono or stereo signals.

An example of the audio processing system 220 that can be used in some embodiments is disclosed in U.S. Pat. No. 8,538,035 issued Sep. 17, 2013 and entitled "Multi-Microphone Robust Noise Suppression", which is incorporated herein by reference in its entirety.

The example first earpiece 112 includes the feedforward microphones 106*a*, 106*b*, and 106*c*, transducer 116, and ANC device 204. In other embodiments, any number of feedforward microphones equal or larger than 2 can be used.

The example ANC device 204 includes processor 204 and ANC processing system 210. The processor 202 may execute instructions and modules stored in a memory (not illustrated in FIG. 3) in the ANC device 204 to perform various operations, including active noise cancellation as described herein.

The ANC processing system 210, in the example in FIG. 3, is configured to receive the reference signals $r_1(t)$, $r_2(t)$, and $r_3(t)$ from the feedforward microphones 106*a*, 106*b*, and 106*c* and process the signals. The processing may include performing active noise cancellation as described herein.

In some embodiments, the acoustic signals received by the feedforward microphones 106*a*, 106*b*, and 106*c* are converted into electrical signals. The electrical signals themselves are converted by an analog to digital converter (not shown) into digital signals for processing in accordance with some embodiments.

In the example in FIG. 3, the active noise cancellation techniques are carried out by the ANC processing system 210 of the ANC device 204. Thus, in the illustrated embodiment, the ANC processing system 210 includes resources to form the feedforward signal f(t) used to perform active noise cancellation. Alternatively, in some embodiments, the feedforward signal f(t) is formed by utilizing resources within the audio processing system 220 of the audio device 104.

Figure 4:
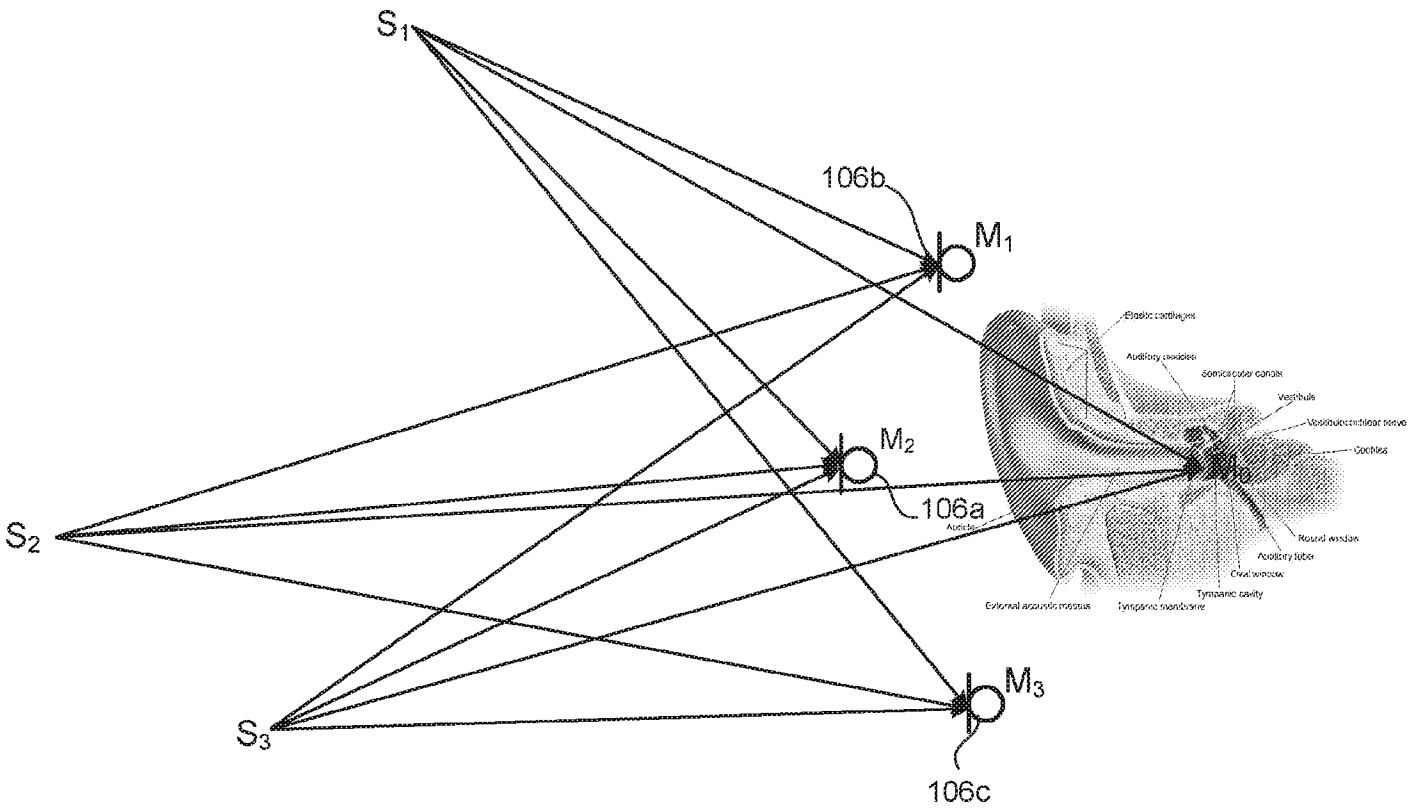
FIG. 4 is an illustration showing a construction of transfer functions, according to an example embodiment.

FIG. 4 is a diagram for use to illustrate various details of computing of the transfer functions for multiple feedforward microphones. As illustrated in FIG. 4, feedforward microphones $M_1$, $M_2$, and $M_3$ are configured to receive acoustic sounds from different directions. In some embodiments, each of the feedforward microphones $M_k$ (k=1, 2, and 3) can be assigned a transfer function $H_{S\rightarrow M_k}(S)$, wherein k=1, 2, and 3. The transfer function $H_{S\rightarrow M_k}(S)$ (k=1, 2, and 3) can be used to filter reference signals $r_1(t)$, $r_2(t)$, and $r_3(t)$ captured by the feedforward microphones $M_k$.

Each of the transfer functions $H_{S\rightarrow M_k}(S)$ (k=1, 2, and 3) depend on the position and characteristics of all of the feedforward microphones $M_k$ (k=1, 2, and 3). If either a position or characteristics of any one of the feedforward microphones is changed, the performance of each filter (which are based on the respective transfer function) degrades.

In some embodiments, each of the feedforward microphones $M_1$, $M_2$, and $M_3$ are operable to receive sound sources $S_1$, $S_2$, and $S_3$ located at pre-determined locations. In some embodiments, transfer functions $H_{S_i\rightarrow M_k}(S)$ (i=1, 2, and 3, k=1, 2, and 3) are calibrated to provide best ANC for noise signals coming from the directions of the sound sources $S_1$, $S_2$, and $S_3$, respectively.

In some embodiments, $M_0$ in FIG. 4 is a location (e.g. a virtual point in the ear drum and perhaps corresponding to first listening position 130) at which the signals from sound sources $S_1$, $S_2$, and $S_3$ are supposed to be canceled out. An example ear with ear drum is shown in FIG. 4. A virtual microphone (e.g., virtual ear drum) or a real microphone can be used at location $M_0$ during calibration (e.g., using a virtual head) to measure the signal the ear drum would receive as part of calibration of the transfer functions. In some embodiments, transfer functions $H_{S_i\rightarrow M_0}(S)$, (i=1, 2, and 3) are calibrated for each sound source $S_1$, $S_2$, and $S_3$. Each $H_{S_i\rightarrow M_0}(S)$ can be, potentially, used for construction of a respective filter that forms a feedforward signal cancelling the signal from $S_i$ at location $M_0$.

In operation, each of the feedforward microphones $M_1$, $M_2$, and $M_3$ can capture an arbitrary sound S from an arbitrary sound source from an arbitrary direction to obtain reference signals $r_1(t)$, $r_2(t)$, and $r_3(t)$, respectively. In some embodiments, each of the reference signals $r_i(t)$ is convolved in a time domain with an individual filter to obtain a filtered signal. An individual filter is determined for feedforward microphone $M_i$. In some embodiments, the individual filter is defined by a combination of transfer functions $H_{S\rightarrow M_k}(S)$ (k=1, 2, and 3). In some embodiments, the filter is a finite impulse response (FIR) filter. In other embodiments, the filter is an infinite impulse response (IIR) filter. The filtered signals are then combined to form a feedforward signal. The feedforward signal is further inverted and sent to transducer (e.g., loudspeaker) 116 to cancel the noise at position $M_0$.

In some embodiments, the transfer functions $H_{S\to M_k}(S)$ (k=1, 2, and 3) are combined to determine individual filters for feedforward microphones in such a way, as to achieve a maximum amount of reduction of noise at the ear drum regardless of the location of the noise source. The noise can be substantially reduced compared to other solutions for the ANC. The method of combining can depend on characteristics and locations of the feedforward microphones. Once an additional feedforward microphone is added to a system, the method of combining of the transfer functions (for example, determining weights) is changed.

In some embodiments, linear coefficients for combining transfer functions to determine an individual filter for a feedforward microphone are obtained by solving a system of equations. If H(s) is a combination of transfer functions for an individual microphone $M_k$, then for a sound signal $S_u$ with a certain frequency u, a combination of transfer function H(s) is:

$$H(S_u)=H_{S_u\to M_1}(S_u)G_{M_1}(S_u)+H_{S_u\to M_2}(S_u)G_{M_2}(S_u)+H_{S_u\to M_3}(S_u)G_{M_3}(S_u) \quad (1)$$

The linear coefficients $G_{M_i}(S_u)$ depend on the frequency u and particular feedforward microphone $M_i$. Since transfer functions for sound sources $S_1$, $S_2$, and $S_3$ are known, the linear coefficients $G_{M_i}(S_u)$, (i=1, 2, and 3) can be found using the following system of equations:

$$\begin{aligned} H_{S_1\to M_0}(S_u)&=H_{S_1\to M_1}(S_u)G_{M_1}(S_u)+H_{S_1\to M_2}(S_u)G_{M_2}(S_u)+H_{S_1\to M_3}(S_u)G_{M_3}(S_u)\\ H_{S_2\to M_0}(S_u)&=H_{S_2\to M_1}(S_u)G_{M_1}(S_u)+H_{S_2\to M_2}(S_u)G_{M_2}(S_u)+H_{S_2\to M_3}(S_u)G_{M_3}(S_u)\\ H_{S_3\to M_0}(S_u)&=H_{S_3\to M_1}(S_u)G_{M_1}(S_u)+H_{S_3\to M_2}(S_u)G_{M_2}(S_u)+H_{S_3\to M_3}(S_u)G_{M_3}(S_u) \end{aligned} \quad (2)$$

In some embodiments, the system (2) is solved in the time domain. Once $G_{M_1}(S_u)$, (i=1, 2, and 3) are found, they can be transformed into a discrete time domain and negated. Generally, if the number of feedforward microphones is N, then a system of N equations with N unknowns is solved for each frequency u. The more feedforward microphones are used in a system, the better are results of the ANC.

Some embodiments of the present disclosure presume the following limitations:

1) number of feedforward microphones is equal or greater than 2;

2) at least one of the feedforward microphones senses noise while the noise can still be canceled. This means that at least one feedforward microphone receives the noise before an ear drum does; and 3) any two of the feedforward microphones cannot be co-located. Various embodiments may include spread out microphones in order to cover all possible directions.

Various embodiments of the present technology can enable effective noise cancellation at higher frequencies.

Various embodiments of the present technology can provide a scalable solution because more feedforward microphones yield better ANC performance.

Further embodiments of the disclosure allow constructing high latency ANC systems. In some embodiments, feedforward microphones are moved away from ear to allow using a larger number of microphones. While in single feedforward microphone ANC systems, greater latency results in worse performance, in multiple feedforward microphone ANC systems, the performance can be improved by increasing the number of the microphones.

Figure 5:
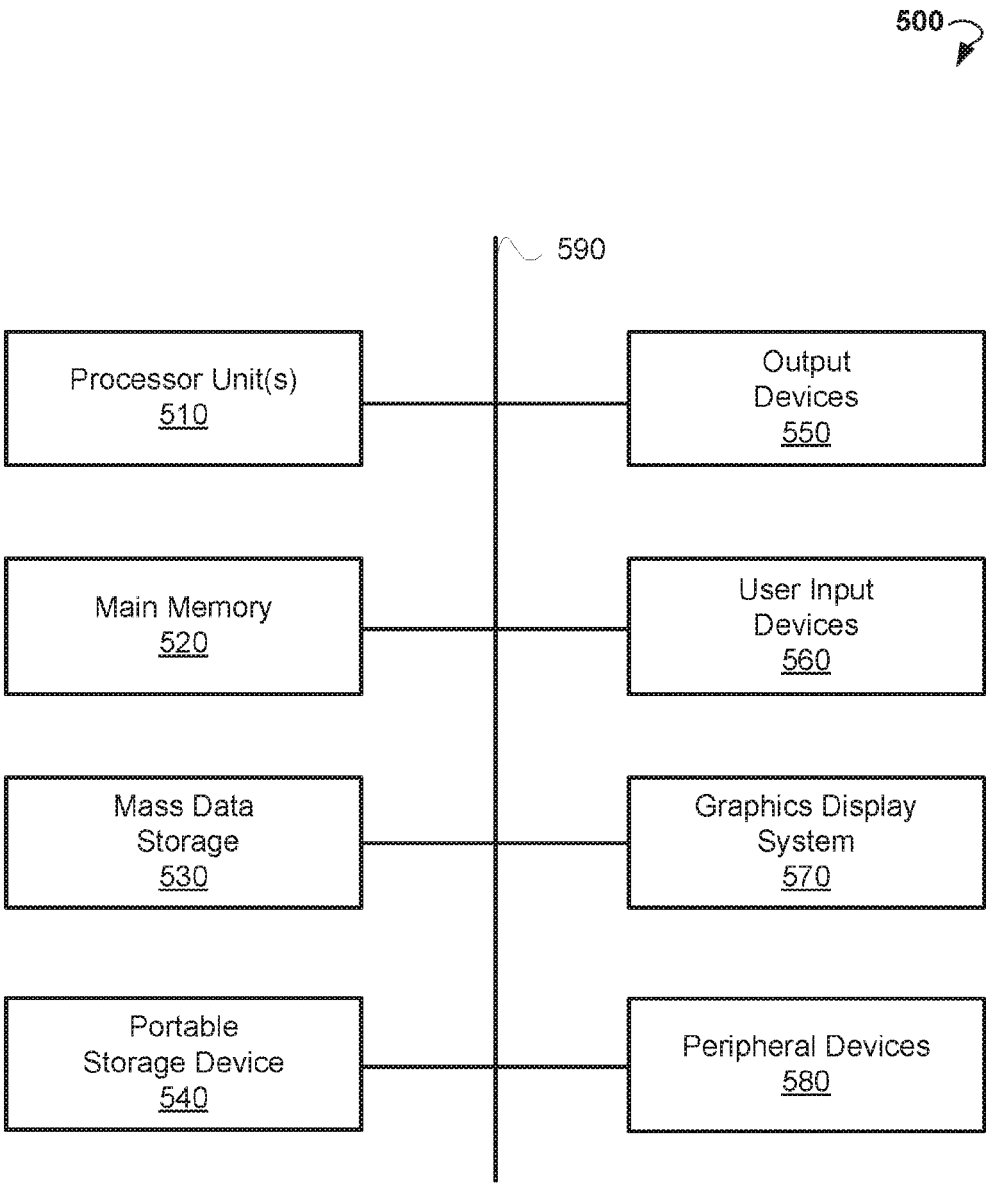
FIG. 5 illustrates an example of a computer system that can be used to implement embodiments of the disclosed technology.

FIG. 5 illustrates an exemplary computer system 500 that may be used to implement some embodiments of the present invention. The computer system 500 of FIG. 5 may be implemented in the contexts of the likes of computing systems, networks, servers, or combinations thereof. The computer system 500 of FIG. 5 includes one or more processor unit(s) 510 and main memory 520. Main memory 520 stores, in part, instructions and data for execution by processor unit(s) 510. Main memory 520 stores the executable code when in operation, in this example. The computer system 500 of FIG. 5 further includes a mass data storage 530, portable storage device 540, output devices 550, user input devices 560, a graphics display system 570, and peripheral devices 580.

The components shown in FIG. 5 are depicted as being connected via a single bus 590. The components may be connected through one or more data transport means. Processor unit 510 and main memory 520 is connected via a local microprocessor bus, and the mass data storage 530, peripheral devices 580, portable storage device 540, and graphics display system 570 are connected via one or more input/output (I/O) buses.

Mass data storage 530, which can be implemented with a magnetic disk drive, solid state drive, or an optical disk drive, is a non-volatile storage device for storing data and instructions for use by processor unit 510. Mass data storage 530 stores the system software for implementing embodiments of the present disclosure for purposes of loading that software into main memory 520.

Portable storage device 540 operates in conjunction with a portable non-volatile storage medium, such as a flash drive, floppy disk, compact disk, digital video disc, or Universal Serial Bus (USB) storage device, to input and output data and code to and from the computer system 500 of FIG. 5. The system software for implementing embodiments of the present disclosure is stored on such a portable medium and input to the computer system 500 via the portable storage device 540.

User input devices 560 can provide a portion of a user interface. User input devices 560 may include one or more microphones, an alphanumeric keypad, such as a keyboard, for inputting alphanumeric and other information, or a pointing device, such as a mouse, a trackball, stylus, or cursor direction keys. User input devices 560 can also include a touchscreen. Additionally, the computer system 500 as shown in FIG. 5 includes output devices 550. Suitable output devices 550 include speakers, printers, network interfaces, and monitors.

Graphics display system 570 include a liquid crystal display (LCD) or other suitable display device. Graphics display system 570 is configurable to receive textual and graphical information and processes the information for output to the display device.

Peripheral devices 580 may include any type of computer support device to add additional functionality to the computer system.

The components provided in the computer system 500 of FIG. 5 are those typically found in computer systems that may be suitable for use with embodiments of the present disclosure and are intended to represent a broad category of such computer components that are well known in the art. Thus, the computer system 500 of FIG. 5 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

The processing for various embodiments may be implemented in software that is cloud-based. In some embodiments, the computer system 500 is implemented as a cloud-based computing environment, such as a virtual machine operating within a computing cloud. In other embodiments, the computer system 500 may itself include a cloud-based computing environment, where the functionalities of the computer system 500 are executed in a distributed fashion. Thus, the computer system 500, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud may be formed, for example, by a network of web servers that comprise a plurality of computing devices, such as the computer system 500, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

What is claimed is:

1. A method for active noise cancellation, the method comprising:

receiving at least two reference signals representing at least one acoustic sound captured respectively by at least two feedforward microphones, the at least one acoustic sound representing an unwanted noise;

filtering the at least two reference signals to obtain filtered signals, the filtering being determined based on a combination of at least two transfer functions, each of the at least two transfer functions being associated with a different one of the at least two feedforward microphones; and combining the filtered signals to obtain a feedforward signal, the feedforward signal being configured such that play back of the feedforward signal causes the unwanted noise to be substantially reduced.

2. The method of claim 1, wherein each of the at least two transfer functions depends on a position and characteristics of the at least two feedforward microphones.

3. The method of claim 2, wherein characteristics include one or more of amplitude, phase shift and time delay between each of the at least two feedforward microphones and a source of the unwanted noise.

4. The method of claim 1, wherein filtering is performed by individual filters, the individual filters being determined based on the combination of the at least two transfer functions.

5. The method of claim 4, wherein the combination comprises a linear combination of the at least two transfer functions.

6. The method of claim 1, wherein the at least two reference signals are respectively associated with at least two reference positions.

7. The method of claim 1, wherein the feedforward signal is configured such that play back of the feedforward signal causes the unwanted noise to be substantially reduced at a pre-determined space location.

8. The method of claim 7, wherein each of the at least two transfer functions incorporates features of an acoustic path between respective positions of the at least two feedforward microphones and the pre-determined space location.

9. The method of claim 1, wherein filtering is performed for a certain frequency, and wherein filtering is further based on a combination of the at least two transfer functions and respective linear coefficients.

10. The method of claim 1, wherein the at least two transfer functions are calibrated for a source of the unwanted noise at respective different source locations.

11. An apparatus comprising:

an audio transducer; and an active noise cancellation (ANC) device operably coupled to the audio transducer for causing the audio transducer to generate an acoustic wave based on a feedforward signal, the ANC device being configured to perform an ANC method, the method comprising:

receiving at least two reference signals representing at least one acoustic sound captured respectively by at least two feedforward microphones, the at least one acoustic sound representing an unwanted noise;

filtering the at least two reference signals to obtain filtered signals, the filtering being determined based on a combination of at least two transfer functions, each of the at least two transfer functions being associated with a different one of the at least two feedforward microphones; and combining the filtered signals to obtain the feedforward signal, the feedforward signal being configured such that play back of the feedforward signal by the audio transducer causes the unwanted noise to be substantially reduced.

12. The apparatus of claim 11, wherein each of the at least two transfer functions depends on a position and characteristics of the at least two feedforward microphones.

13. The apparatus of claim 12, wherein characteristics include one or more of amplitude, phase shift and time delay between each of the at least two feedforward microphones and a source of the unwanted noise.

14. The apparatus of claim 11, wherein the at least two reference signals are respectively associated with at least two reference positions on the apparatus where the at least two feedforward microphones are located.

15. The apparatus of claim 11, wherein the feedforward signal is configured such that play back of the feedforward signal causes the unwanted noise to be substantially reduced at a pre-determined space location.

16. The apparatus of claim 15, wherein each of the at least two transfer functions incorporates features of an acoustic path between respective positions of the at least two feedforward microphones and the pre-determined space location.

17. The apparatus of claim 16, wherein the pre-determined space location corresponds to a ear canal of a listener when the apparatus is worn on the head of the listener.

18. The apparatus of claim 11, wherein filtering is performed for a certain frequency, and wherein filtering is further based on a combination of the at least two transfer functions and respective linear coefficients.

19. The apparatus of claim 11, wherein the at least two transfer functions are calibrated for a source of the unwanted noise at respective different source locations.

20. The apparatus of claim 11, wherein the audio transducer is further configured to generate the acoustic wave based on a combination of the feedforward signal and a desired signal.

* * * * *